US007233677B2

(12) United States Patent
Moore

(10) Patent No.: US 7,233,677 B2
(45) Date of Patent: Jun. 19, 2007

(54) TOP-LOADING FOLDED CORNER HORN

(75) Inventor: Dana A. Moore, Bothell, WA (US)
(73) Assignee: Dana Moore, Bothell, WA (US)

( * ) Notice: Subject to any disclaimer, the term of this patent is extended or adjusted under 35 U.S.C. 154(b) by 567 days.

(21) Appl. No.: 10/864,657

(22) Filed: Jun. 9, 2004

(65) Prior Publication Data

US 2005/0276431 A1 Dec. 15, 2005

(51) Int. Cl.
*H04R 1/28* (2006.01)

(52) U.S. Cl. ..... 381/341; 381/352

(58) Field of Classification Search ..... 381/160, 381/349, 352, 386, 338, 340, 341; 181/148, 181/150, 152, 155, 156
See application file for complete search history.

(56) References Cited

U.S. PATENT DOCUMENTS 2,310,243 A * 2/1943 Klipsch ..... 181/152

* cited by examiner

*Primary Examiner*—Sinh Tran
*Assistant Examiner*—Brian Ensey

(57) ABSTRACT

A low frequency exponential horn enclosure intended for corner use with access to the horn throat and entire volume of the back chamber from the top of the enclosure, allowing operation as either a front or back loaded horn. The horn is bifurcated at the throat and folds horizontally around a central triangle-shaped columnar back chamber, the sides of which form part of the horn channel, forming a simple structure with little void space.

14 Claims, 2 Drawing Sheets

TOP-LOADING FOLDED CORNER HORN

CROSS REFERENCE TO RELATED APPLICATIONS

Not Applicable

STATEMENT REGARDING FEDERALLY SPONSORED RESEARCH OR DEVELOPMENT

Not Applicable

REFERENCE TO SEQUENCE LISTING, A TABLE, OR A COMPUTER PROGRAM LISTING COMPACT DISK APPENDIX

Not Applicable

BACKGROUND OF THE INVENTION

The present invention pertains to loudspeaker enclosures of the low frequency exponential folded horn type intended for corner placement.

The current audiophile interest in high efficiency loudspeakers and enclosures that maximize speaker efficiency are again making older proven technologies potentially profitable if an appropriate balance of performance, versatility, cost and ease of manufacture can be attained. With the addition of the "Home Theatre" consumer market, there is another potential economic avenue for large loudspeakers whose performance approaches the overall sound quality as one might find in commercial theatres.

It is well known in the art that corner placement of loudspeakers provides the most efficient reproduction of low bass notes. The projection of bass waveforms into a $\pi/2$ solid angle allows for the reduction of the physical size of the loudspeaker horn enclosure by 8 times. This allows a bifurcated exponential horn folded to use the corner walls as part of the horn itself with a nominal low frequency cutoff (Fc) of 40 Hz to be achieved in a relatively compact enclosure.

The U.S. Pat. No. 2,373,692 to Klipsch teaches what has become a time-proven design that, while providing a true 40 Hz cutoff exponential horn in the smallest possible footprint, it provides access to the horn throat from one side only, and is specifically designed for and is limited to only one topology of use. It should be noted, however, that the Klipsch invention is still in commercial production and has remained the de facto performance and production standard for this genre of loudspeaker for over 50 years.

The U.S. Pat. No. 2,815,086 to Hartsfield teaches a corner horn design featuring top access to the horn throat, but the design is complex and complicated to build, and has been out of production for decades. It also features an alternative use intermediate horn that allows for the bass horn cabinet to be used to rear-load a full-range driver.

Both of the above cited prior art examples are known in the art as front-loaded exponential horns, in that the front of the driver feeds directly into the horn throat (whether with or without a filtering cavity), and the back chamber for the driver is sealed from the atmosphere (with the exception of the alternative Hartsfield configuration as described previously).

The formulas for calculating the values of exponential horns are well known in the art. Such examples can be found in the text "How to Build Speaker Enclosures", by Alexis Badmaieff and Don Davis, Howard W. Sams and Company, Indianapolis, Ind., 13th printing (1978) pages 86 through 91.

Whereas both of the previously cited examples of the prior art may be purchased new today from various sources, the retail prices involved are daunting, most likely due to the complexity of the designs and the resulting need for highly skilled labor. Therefore, the need exists for a less complicated method of achieving relatively the same performance at a reduced cost.

SUMMARY OF THE INVENTION

It is an object of the present invention to provide substantially the same performance as in the previously cited examples while providing access to the horn throat from the top of the cabinet. An additional object of the invention is to reduce the complexity and number of the parts involved without the undue sacrifice of performance. It is a further object of the present invention to provide a greater ease and variety of manufacture than presented by the either of the previously cited examples.

The current invention departs from the previously cited examples of corner horns in that it folds horizontally from the horn throat for its entire length. It incorporates a single exponential expansion rate, that is, it does not incorporate a "rubber throat". Also the number of component parts is reduced as compared to either of the previously cited prior art examples, allowing for easier manufacture. Additionally, the nature of the parts involved is less complicated to manufacture.

The disclosed invention is readily scalable for a desired Fc, and is simple enough that a variety of manufacturing techniques and materials may be employed in its manufacture and construction, such as the casting of parts, fiber-glass molding, the molding of various plastic materials, the use of structural foam, the economical use of robotic cutting tools and supporting software parameter definition, and so forth. Any one of these aforementioned methodologies would promote the use of pre-assembled or prefabricated assemblies of component parts and further simplify construction.

The current invention also provides the advantage for the use of various forms of drivers to be employed without modifications via the access to the horn throat opening from the top of the cabinet. The insertion of a driver or set of drivers, or an intermediate horn, column, resonator, or combination thereof, allows for the bass horn to be used as a either a front or back (or rear) loaded horn.

The present invention is also comparatively sized with the two previously cited prior art examples, which is primarily a matter of the chosen Fc. The present invention embodiment described herein is designed for a 40 Hz Fc as is the Klipsch commercial example cited above and the overall performance is also competitive with the two previously cited examples.

DESCRIPTION OF THE INVENTION

Figure 1:
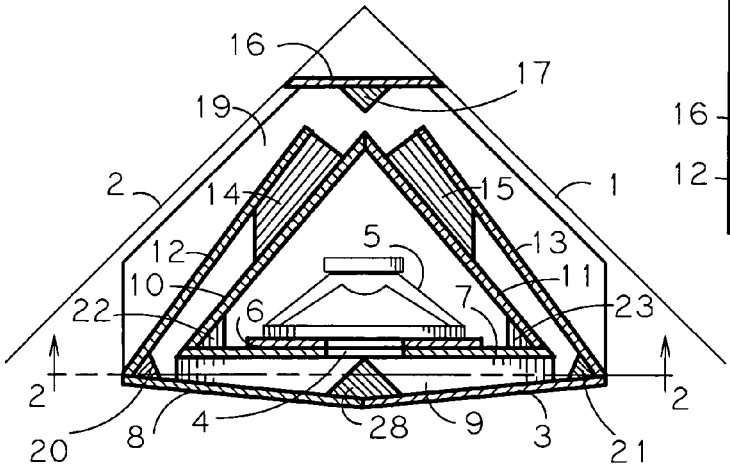
FIG. 1 is a sectional view from line 1-1 of FIG. 3 describing corner placement.
Figure 4:
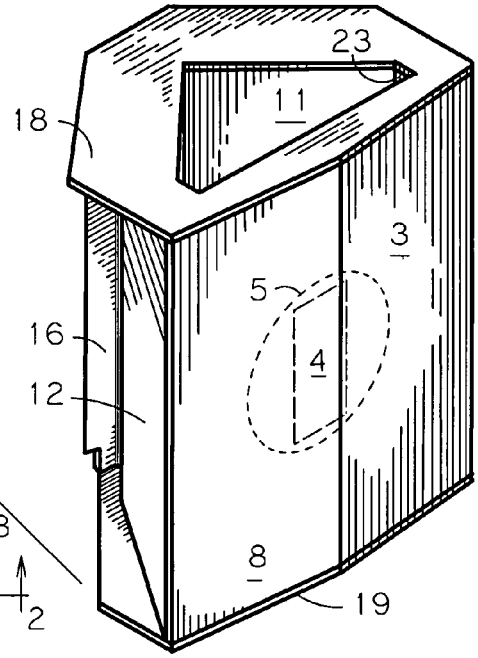
FIG. 4 is a perspective view of the invention showing the orientation of the throat cavity opening and the orientation of the driver as a reference.

Referring to FIG. 1, the concept of the present invention is basically a triangular form within a triangular form, and when placed in a corner, a third outer angular form is added which completes the horn. The secondary triangular form enclosing the first triangular form is open at the back and the angles of the separation between the triangles are designed to provide an expanding exponential cross-section area that doubles its size at the specified length. The illustrated invention is defined for a 40 Hz frequency cutoff (Fc) or an exponential expansion doubling length of 21.7 inches. Therefore the cross-sectional area of the respective horn channel in square inches has to double its size every 21.7 inches of horizontal travel. The bifurcation of the horn provides the smallest enclosure size for the horn length involved and allows for the folds to occur relatively close to the horn throat reducing the possibility of producing standing waves.

The present invention contains a triangular back chamber formed from parts 7, 10, 11 forming a vertically oriented column which is sealed against air leaks except for the top panel 18 access cutout and throat cavity opening 4. The throat cavity opening 4 exists on the front-facing baffle 7 portion of the back chamber and is configured to accept and mount a driver mounting board 6 or a board of the same configuration 35 used to connect a intermediate horn 34 or alternative to the throat cavity opening 4 in a manner common in the present art. The corner braces 22 and 23 provide an attachment substrate and also are specifically sized to displace a certain amount of volume in the back chamber.

The theoretical volume of the back chamber and/or throat area is defined by the following formula:

$$A=V/2.9R$$

Where A=throat area in square inches

V=back chamber volume in cubic inches

R=length of expansion rate doubling in inches

In the present disclosure, the value of A is 78 square inches, the value of V is 4911 cubic inches, and the value of R is 21.7 inches. The actual volume of the disclosed back chamber is approximately 5100 cubic inches. This variance allows for the displacement of volume due to the immersion of the driver 5 and mounting board 6 combination into the back chamber.

The vertically-oriented throat cavity opening 4 is bifurcated via the throat splitting wedges 28, 29 which are intended to turn the waveform 90 degrees into the horizontal exponential channels formed by parts 24, 25, 26, 27 and 9 with the least turbulence possible. The splitting wedges 28, 29 also provide an attachment substrate for the front panels 3, 8 as does the horizontal brace 9, and the baffle parts 24, 25, 26, 27.

Figure 2:
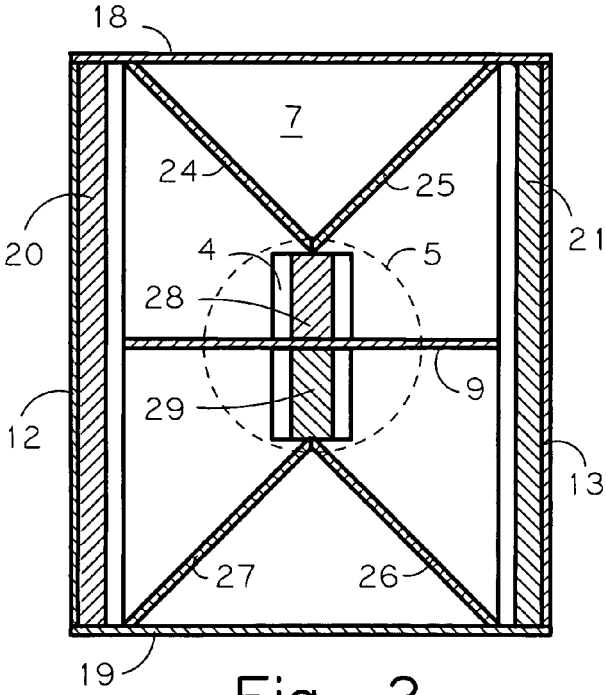
FIG. 2 is a sectional view from line 2-2 of FIG. 1 describing the throat and initial horn channels from the front.
Figure 3:
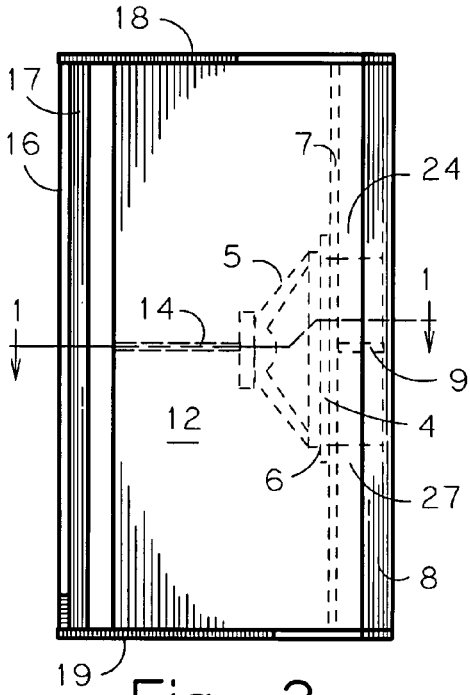
FIG. 3 is a side elevation view showing the orientation of the driver as a reference.

Referring to FIG. 2, the front exponential baffles 24, 25, 26, 27 are arranged in such a manner that in concert with the angled front cover panels 3, 8 the proper cross-sectional area for the correct expansion rate is maintained. The exaggerated front exponential baffles expansion rate is counteracted by the receding angle of the front panels 3, 8 along the first section of the horn. The function of this design element is to elongate the exponential channels to the full height of the enclosure at the location of the first fold. The employment of this specific design element allows for a simplified horn channel structure to be used between the first and second folds than would be otherwise required, that is, it requires fewer parts to make up the respective horn channels, and also results in a smaller footprint than would otherwise be required for the given Fc and exponential expansion rate given that the height of the enclosure remains unchanged. It also serves to give the invention a distinctive appearance. The exponential channel corner braces 20, 21 serve two functions, as an attachment substrate and reducing turbulence when turning the waveform around the first fold.

The top 18 and bottom 19 panels provide the vertical limits to the horn channels for the entire horn length and also provide attachment points for the optional addition of ornamental grill cloth frames. The top panel 18 also features a cutout opening, which provides access to the back chamber. The bottom panel 19 does not fully extend to the walls of the corner in order to avoid contact with possible floor moldings typically associated with interior walls.

The side exponential horn channels are formed by the outer sides of the back chamber 10, 11 and the inner sides of the outer side panels 12, 13. The simple exponential expansion is horizontal only and proceeds at the same rate for the Fc of the horn. The horizontal channel braces 14, 15 are for suppressing vibration in the side panels and provide an attachment substrate for the side panels. All of the baffled horn channels in the cabinet are sealed against air leaks.

The exponential expansion rate is maintained in the second and final fold at the back of the enclosure, referring to FIG. 1. The back wedge 17 serves two purposes, to promote the bifurcation of the converging horn channels at the rear of the enclosure, and to strengthen the back reflector panel 16 against excessive vibration.

The final exponential expansion channels are formed by the outer side panels 12, 13 and the environment corner walls 1, 2. The horn mouth occurs along the walls at the point of horizontal travel where the enclosure physically ends and the horn itself begins to unload.

The overall length of the present invention exponential horn is approximately 61 inches, measured center of channel.

Figure 5:
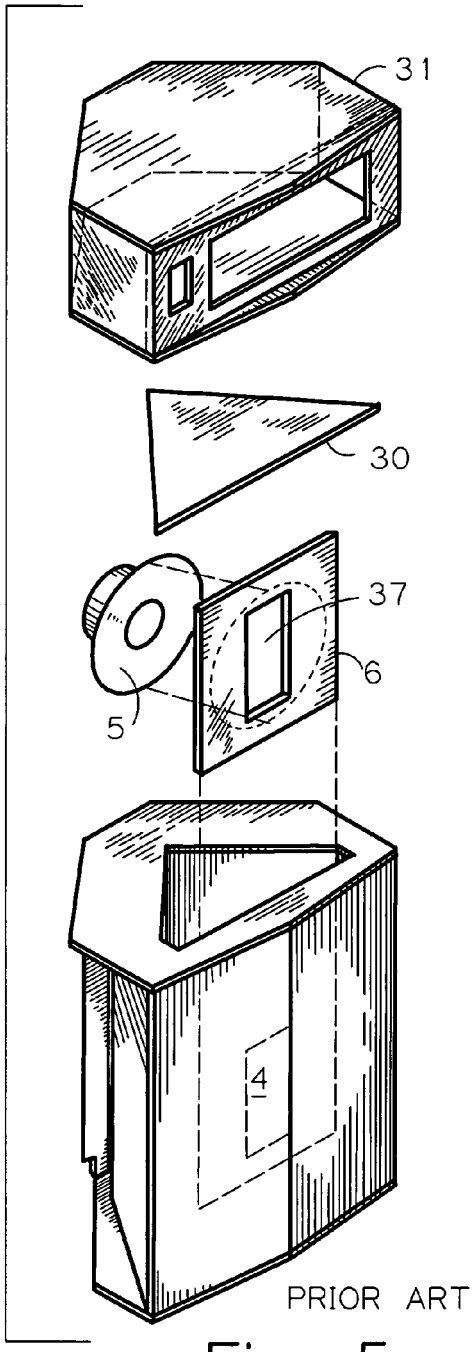
FIG. 5 is an exploded view describing the orientation and nature of the traditional 2 or 3-way all horn-loaded embodiment.

The traditional all-horn driven 2 or 3-way configuration is described in FIG. 5. The driver 5 is attached to the driver mounting board 6 and the driver/board assembly is then mounted to the horn throat opening via the top access opening in the enclosure using means in common use. The back chamber is then sealed to the atmosphere by attaching the access panel 30 to the bass horn enclosure, as is in common use. The top cabinet 31 is then placed on top of the bass horn cabinet, as is in common use.

The driver mounting board 6 or alternative use mounting board 35 may be used as an acoustic filter by using a smaller area cutout 36 and 37, respectively, than the horn throat cavity opening 4. The size of the filter opening to be used is dependent on the particular application.

Figure 6:
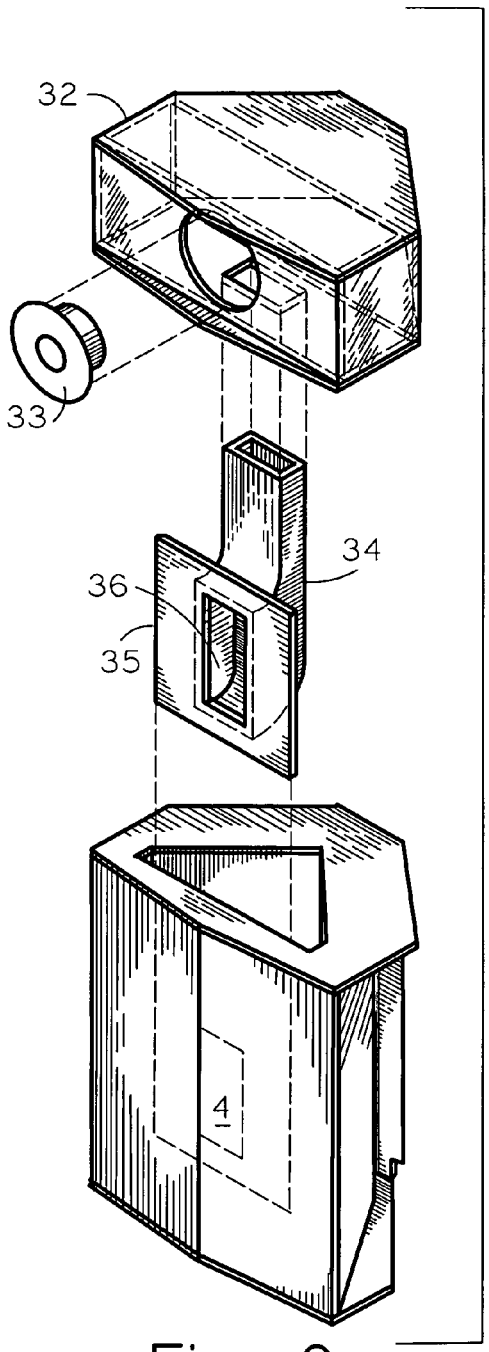
FIG. 6 is an exploded view describing the orientation and nature of the alternative rear-loaded full-range driver embodiment.

In the alternative use configuration as disclosed in FIG. 6, the full range driver 33 is mounted into the top cabinet 32 and via a port is rear-loaded using the intermediate horn 34 as a sound coupler and the intermediate horn mouth 36 to mate to the bass horn throat cavity opening 4 using the alternate use mounting board 35 in a manner common to the art.

It should be realized that the alternative use could include multiple drivers and an apparatus to mount the set to a mounting board configured to mate to the horn throat opening using a method as is in common use. The possible alternative configurations are therefore many and should not be limited to only that which is defined in the drawings.

Wherein this disclosure depicts one specific type of manufacture, it should not be limited to materials and processes that utilize only straight planar elements, such as plywood and the like. It should also be noted that while straight lines have been used for describing the various horn channels and the splitting wedges, an alternative and perhaps better embodiment could utilize curved or concave elements which would promote an even rotational angle or approximate a true exponential curve more closely.

While in accordance with the provisions of the Patent Statutes, the preferred forms and embodiments have been illustrated and described, it will become apparent to those skilled in the art that various changes and modifications may be made without deviating from the inventive concepts set forth above.

I claim:

1. In a horn type loudspeaker wherein proximate surfaces cooperate to form horn channels of the speaker, a cabinet comprised of two front panels abutted together at the proximate sides with each panel arranged in an opposite rearwardly receding angle from the abutment at the frontal plane, said two front panels sized and arranged so as to allow open spaces between their side edges and the proximate surfaces, an inner panel spaced rearwardly of said two front panels and having a throat opening therein, two inner side panels engaged with the outside edges of said inner panel, converging rearwardly of said inner panel to form a triangular air chamber, two outer side panels converging rearwardly, engaged with the outside edges of said front panels, spaced from said inner side panels and outer proximate surfaces to form the flaring portions of the inner and outer horn sections therewith, a back reflecting panel, arranged rearwardly of said air chamber, baffles cooperating with said throat opening and said front panels to create an equal division of the air column forward of said throat opening, forming two horizontal horn sections flaring in opposite directions from said throat opening to said inner horn sections, means for completing said horn sections, and an apertured panel for enabling the sealed engagement of a sound transmitting means, mounted rearwardly of said throat opening and cooperating therewith, to transmit sound through said throat opening and said horn sections therebeyond.

2. In a horn type loudspeaker as set forth in claim 1, wherein said air chamber being arranged to enclose a volume of air sufficient to offset the reactance at said throat resulting from the resistance to movement presented by the volume of air in said horn channels.

3. In a horn type loudspeaker as set forth in claim 1, wherein said means includes a top panel in engagement with the ends of said front and converging panels and extending outwardly to engage said proximate surfaces, forming a closure for said opening and said horn sections.

4. In a horn type loudspeaker as set forth in claim 3, wherein said top panel is apertured to provide unencumbered vertical access to the entire internal volume of said air chamber and rear of said throat opening therein.

5. In a horn type loudspeaker as set forth in claim 1, wherein said means further includes a bottom panel in engagement with the ends of said front and converging panels, extending outwards toward said proximate surfaces, albeit with outward extension limited to avoid possible impediments toward the proximate surfaces, and forming a closure for said opening, said chamber, and said horn sections.

6. In a horn type loudspeaker as set forth in claim 1, wherein said sound transmitting means consists of at least one driving unit.

7. In a horn type loudspeaker as set forth in claim 1, wherein said sound transmitting means consists of a sound-coupling adapter.

8. A horn loudspeaker comprising a triangle-shaped columnar air chamber defined by baffles, one of said baffles being apertured and adapted to support at least one driving unit in operating relation to said aperture, additional baffles defining an expanding air column from said aperture and arranged to fold said air column horizontally around said air chamber successively in opposite directions, the baffles comprising the last fold being adapted to cooperate with corner wall and floor surfaces to complete the terminal section of said air column, a top panel, adapted and apertured so as to define a passage to the interior of said air chamber, a bottom panel, and a removable access panel, adapted and arranged so as to seal said air chamber from the atmosphere.

9. A horn loudspeaker as set forth in claim 8, wherein said apertured baffle is arranged frontally.

10. A horn loudspeaker as set forth in claim 9, wherein said aperture is of a pre-determined size.

11. A horn loudspeaker as set forth in claim 10, wherein said aperture in said baffle is arranged centrally, and consisting of a rectangular shape, is oriented lengthwise vertically therein.

12. A horn loudspeaker as set forth in claim 8, wherein said additional baffles includes certain baffles proximate to said aperture being arranged so as to bifurcate said air column and define the cross-sectional area of said air column proximate to said aperture as being substantially the same as the cross-sectional area of said aperture.

13. A horn loudspeaker as set forth in claim 12, wherein said certain baffles further being arranged so as to elongate said air column to the height of said air chamber proximate to the first of said folds while maintaining the correct exponential expansion rate as determined by the horizontal travel of said air column to said folds.

14. A horn loudspeaker as set forth in claim 8, wherein said air column follows a substantially exponential pathway from said aperture to said terminal section.

* * * * *